US009306258B2

(12) United States Patent
Chun et al.

(10) Patent No.: US 9,306,258 B2
(45) Date of Patent: Apr. 5, 2016

(54) MIXED-MODE CAVITY FILTER

(71) Applicant: ACE TECHNOLOGIES CORPORATION, Incheon (KR)

(72) Inventors: Dong-Wan Chun, Incheon (KR); Jae-Won Jang, Gyeonggi-do (KR); Jae-Ok Seo, Gyeonggi-do (KR)

(73) Assignee: ACE TECHNOLOGIES CORPORATION, Incheon (KR)

( * ) Notice: Subject to any disclaimer, the term of this patent is extended or adjusted under 35 U.S.C. 154(b) by 0 days.

(21) Appl. No.: 14/173,661

(22) Filed: Feb. 5, 2014

(65) Prior Publication Data

US 2014/0225685 A1 Aug. 14, 2014

(30) Foreign Application Priority Data

Feb. 8, 2013 (KR) ..... 10-2013-0014593
Jan. 15, 2014 (KR) ..... 10-2014-0005195

(51) Int. Cl.
*H01P 1/208* (2006.01)
*H01P 1/205* (2006.01)
*H01P 1/20* (2006.01)

(52) U.S. Cl.
CPC ..... *H01P 1/2084* (2013.01); *H01P 1/2053* (2013.01); *H01P 1/20* (2013.01)

(58) Field of Classification Search
CPC ..... H01P 1/20; H01P 1/203; H01P 1/205; H01P 1/207
USPC ..... 333/202, 227, 233
See application file for complete search history.

(56) References Cited

U.S. PATENT DOCUMENTS

2009/0256651 A1* 10/2009 Salehi ..... 333/202
2012/0242425 A1* 9/2012 Burke et al. ..... 333/202
2012/0293281 A1* 11/2012 Chun et al. ..... 333/202

* cited by examiner

*Primary Examiner* — John Poos
(74) *Attorney, Agent, or Firm* — TechLaw LLP

(57) ABSTRACT

A mixed-mode cavity filter is disclosed. The disclosed cavity filter includes: at least one first cavity configured to hold a metal coaxial resonator; and at least one second cavity configured to hold a dielectric resonator, where a first coupling window is formed in a wall formed between the first cavity and the second cavity, the first coupling window includes a horizontal window formed parallel to a bottom portion and a vertical window formed perpendicularly to the bottom portion, and the horizontal window and the vertical window overlap each other in at least a partial area. A mixed-mode filter according to an embodiment of the invention can achieve a small size and a light weight while providing low losses.

5 Claims, 6 Drawing Sheets

MIXED-MODE CAVITY FILTER

CROSS-REFERENCE TO RELATED APPLICATIONS

This application claims the benefit of Korean Patent Application No. 10-2013-0014593, filed with the Korean Intellectual Property Office on Feb. 8, 2013, and Korean Patent Application No. 10-2014-0005195, filed with the Korean Intellectual Property Office on Jan. 15, 2014, the disclosures of which are incorporated herein by reference in their entirety.

BACKGROUND

1. Technical Field

Embodiments of the present invention relate to a cavity filter, more particularly to a mixed-mode cavity filter in which different modes are combined.

2. Description of the Related Art

Advances in communication services lead to increased transmission speeds, which in turn require increases in system bandwidth, improved reception sensitivity, and minimized interference from carriers of other communication systems.

As such, there is a growing demand for a broadband filter that offers low insertion loss and high rejection. Also, in order to prevent loss in transmission power and decreases in reception sensitivity due to a base station's power feed cables, most RF units are being installed directly below the base station antenna; a few examples including the tower mounted amplifier (TMA), the remote radio head (RRH), and the radio integrated antenna (RIA).

Due to the characteristic of being installed directly below the antenna, an RF unit is required to have a small size and a light weight. Thus, there is active research under way aimed at reducing the size of the filter, which accounts for a large part of the unit's weight and size.

Dielectric resonators can provide low insertion loss properties, but relatively larger sizes and higher costs may be required. Metal coaxial resonators can provide a smaller and more light-weight filter, but may be subject to high losses.

SUMMARY

To resolve the problems of the related art described above, an aspect of the invention proposes a mixed-mode cavity filter that offers the benefits of both a cavity filter using metal coaxial resonators and a cavity filter using dielectric resonators.

Also, an aspect of the invention proposes a mixed-mode cavity filter that can achieve a small size and a light weight while providing low losses.

To achieve the objectives above, an aspect of the invention provides a mixed-mode cavity filter that includes: at least one first cavity configured to hold a metal coaxial resonator; and at least one second cavity configured to hold a dielectric resonator, where a first coupling window is formed in a wall formed between the first cavity and the second cavity, the first coupling window includes a horizontal window formed parallel to a bottom portion and a vertical window formed perpendicularly to the bottom portion, and the horizontal window and the vertical window overlap each other in at least a partial area.

The first coupling window can have an "L" shape, a "T" shape, or a "T" shape with the longitudinal axis biased towards either side portion.

A second coupling window may be formed in a wall between the first cavities for holding metal coaxial resonators or in a wall between the second cavities for holding dielectric resonators, and the second coupling window can have a horizontal structure parallel to the bottom portion.

The horizontal window of the first coupling window may be formed in an upper portion of the wall between the first cavity and the second cavity.

A third coupling window may be formed in a wall for cross-coupling between the first cavity and the second cavity, the third coupling window comprises a horizontal window formed parallel to a bottom portion and a vertical window formed perpendicularly to the bottom portion, and the horizontal window and the vertical window overlap each other in at least a partial area.

The position of a transmission zero by cross-coupling may be adjusted according to the position of the overlap between the horizontal window and the vertical window.

Another aspect of the invention provides a mixed-mode cavity filter that includes: at least one first cavity configured to hold a metal coaxial resonator; and at least one second cavity configured to hold a dual-mode dielectric resonator, where a first coupling window is formed in a wall between the first cavity and the second cavity in cases where magnetic fields coupled between the first cavity and the second cavity are perpendicular to each other, the first coupling window comprises a horizontal window formed parallel to a bottom portion and a vertical window formed perpendicularly to the bottom portion, and the horizontal window and the vertical window overlap each other in at least a partial area.

A mixed-mode filter according to an embodiment of the invention can achieve a small size and a light weight while providing low losses.

Additional aspects and advantages of the present invention will be set forth in part in the description which follows, and in part will be obvious from the description, or may be learned by practice of the invention.

DETAILED DESCRIPTION

Figure 1:
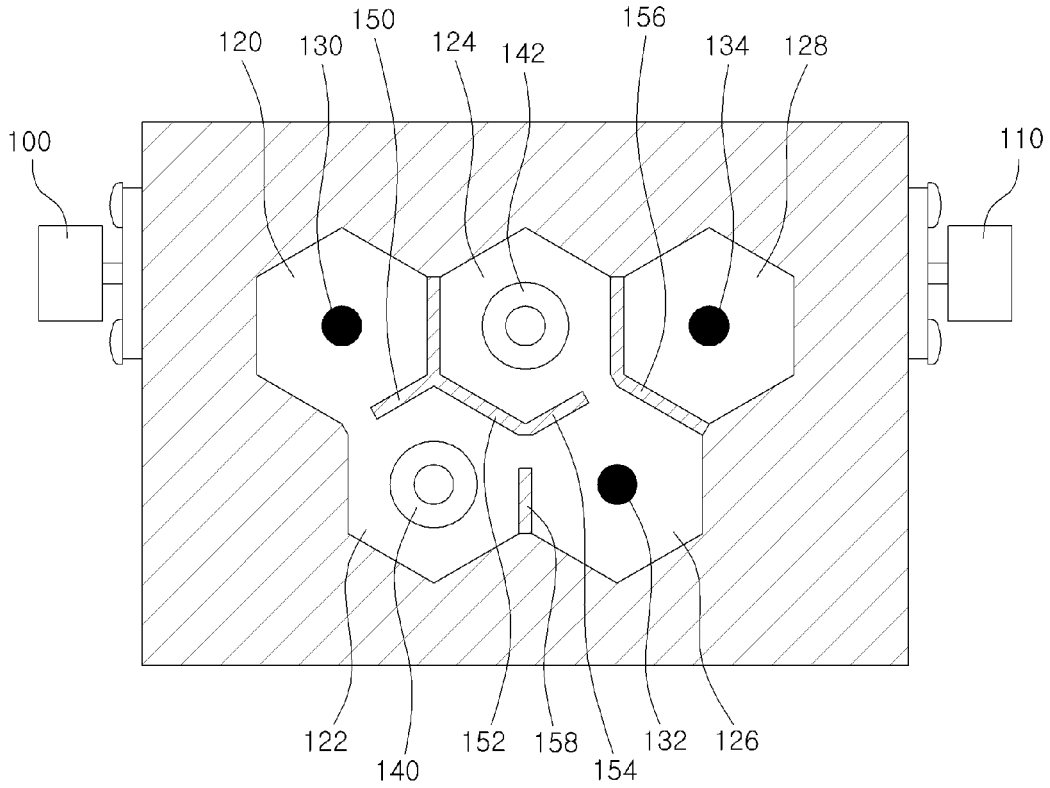
FIG. 1 is a plan view of a mixed-mode cavity filter, with the cover removed, according to a first disclosed embodiment of the invention.

As the present invention allows for various changes and numerous embodiments, particular embodiments will be illustrated in the drawings and described in detail in the written description. However, this is not intended to limit the present invention to particular modes of practice, and it is to be appreciated that all changes, equivalents, and substitutes that do not depart from the spirit and technical scope of the present invention are encompassed in the present invention. In describing the drawings, like reference numerals are used for like elements.

Certain embodiments of the invention will be described below in more detail with reference to the accompanying drawings.

FIG. 1 is a plan view of a mixed-mode cavity filter, with the cover removed, according to a first disclosed embodiment of the invention.

Referring to FIG. 1, a mixed-mode cavity filter according to a first disclosed embodiment of the invention may include an input port 100, an output port 110, a multiple number of cavities 120, 122, 124, 126, 128, a multiple number of metal coaxial resonators 130, 132, 134, and a multiple number of dielectric resonators 140, 142.

The filter illustrated in FIG. 1 may be a cavity filter in which resonators are held in the multiple cavities. The cavity filter may be used in equipment that handles high-power signals such as at a base station or a repeater.

The cavity filter may be divided into the metal coaxial resonator filter and the dielectric resonator filter according to the type of resonator held in each cavity.

An aspect of the present invention proposes a mixed-mode filter, in which metal coaxial resonators and dielectric resonators are used together. Thus, from among the multiple cavities 120, 122, 124, 126, 128, some cavities 120, 126, 128 may hold metal coaxial resonators 130, 132, 134, while some cavities 122, 124 may hold dielectric resonators 140, 142.

A cavity 120, 122, 124, 126, 128 is a space in which resonance occurs. A dielectric resonator or a metal coaxial resonator may be included in each cavity, and the resonance frequency of the filter may be determined by the sizes of the cavities and the forms and sizes of the resonators.

The number of cavities and the number of resonators held in the cavities may be decided based on the insertion loss and the attenuation properties of the filter. An increase in the number of cavities may improve the attenuation properties of the filter but may increase insertion loss. Thus, the number of cavities may be decided based on the required attenuation properties and insertion loss. The structure illustrated in FIG. 1 that includes five cavities is merely given as an example, and the number of cavities can be modified as needed.

The signals that are to be filtered may be inputted to the input port 100, and a signal provided to the input port 100 may be provided to a first cavity 120. A filtered frequency signal may be outputted through the output port 110.

In the filter based on a first disclosed embodiment illustrated in FIG. 1, a frequency signal inputted through the input port 100 may be coupled according to the sequence of first cavity 120→second cavity 122→third cavity 124→fourth cavity 126→fifth cavity 128. Between the cavities, walls 150, 152, 154, 156, 158 may be formed for defining each cavity space. In each wall, a coupling window may be formed for the coupling of signals.

The first cavity 120 may hold a first metal coaxial resonator 130, and the second cavity 122 may hold a first dielectric resonator 140, and as such, the resonance modes of the first cavity 120 and the second cavity 122 may be different.

In the first cavity 120, which uses a metal coaxial resonator, a magnetic field may be formed to rotate about the longitudinal axis of the metal coaxial resonator. However, in the second cavity, which uses a dielectric resonator, a magnetic field may be formed in a direction orthogonal to the magnetic field of the first cavity that uses a metal coaxial resonator.

Since the magnetic fields formed at the first cavity 120 and second cavity 122 are thus formed orthogonally to each other, coupling from the first cavity 120 to the second cavity 122 cannot occur with a general horizontal window. Hence, an aspect of the present invention proposes a new structure for a coupling window that enables coupling between cavities of different resonance modes.

This new structure for a coupling window may be applied not only to the wall between the first cavity 120 and the second cavity 122 but also to the wall between the third cavity 124 and fourth cavity 126, as well as the wall between the second cavity 122 and the fourth cavity 126 for cross-coupling.

Figure 2:
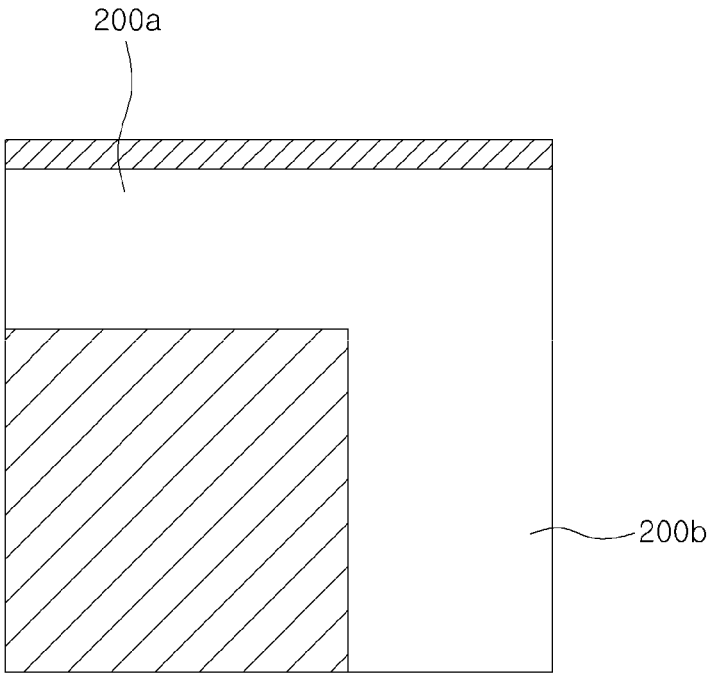
FIG. 2 illustrates an example of a coupling window structure formed in a wall between a metal coaxial resonator cavity and a dielectric resonator cavity in a mixed-mode cavity filter according to an embodiment of the invention.

FIG. 2 illustrates an example of a coupling window structure formed in a wall between a metal coaxial resonator cavity and a dielectric resonator cavity in a mixed-mode cavity filter according to an embodiment of the invention.

Referring to FIG. 2, a coupling window according to an embodiment of the invention may include a horizontal window 200*a* and a vertical window 200*b*. In FIG. 2, the hatched portions correspond to the wall, and the non-hatched portions correspond to the windows. The horizontal window 200*a* and the vertical window 200*b* may be connected with at least a partial overlap. In FIG. 2, the hatched area at the top represents the cover.

The horizontal window 200*a* may be structured such that a portion of the upper part of the wall is open along a horizontal direction, while the vertical window 200*b* may be structured such that the wall is partially open in a vertical direction from the upper part of the wall.

In FIG. 2, the right end of the horizontal window 200*a* connects with the vertical window 200*b*, so that the coupling window has an "L" shape.

With the coupling window formed in a structure having a horizontal window 200*a* and a vertical window 200*b* joined together, as illustrated in FIG. 2, it is possible to achieve coupling of frequency signals between the coaxial resonator cavity and the dielectric resonator cavity, which exhibit different modes.

Figure 3:
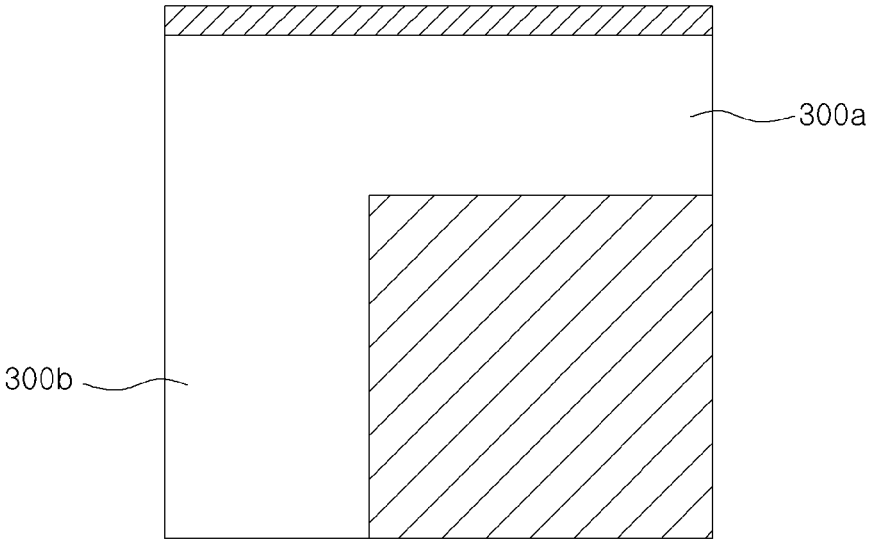
FIG. 3 illustrates another example of a coupling window structure formed in a wall between a metal coaxial resonator cavity and a dielectric resonator cavity in a mixed-mode cavity filter according to an embodiment of the invention.

FIG. 3 illustrates another example of a coupling window structure formed in a wall between a metal coaxial resonator cavity and a dielectric resonator cavity in a mixed-mode cavity filter according to an embodiment of the invention.

Referring to FIG. 3, a coupling window according to an embodiment of the invention may include a horizontal window 300*a* and a vertical window 300*b*, where the vertical window 300*b* may overlap the left end of the horizontal window 300*a*.

The coupling windows illustrated in FIG. 2 and FIG. 3 differ only in the position where the vertical window and the horizontal window overlap, and both have the same basic structure having an "L" shape.

Figure 4:
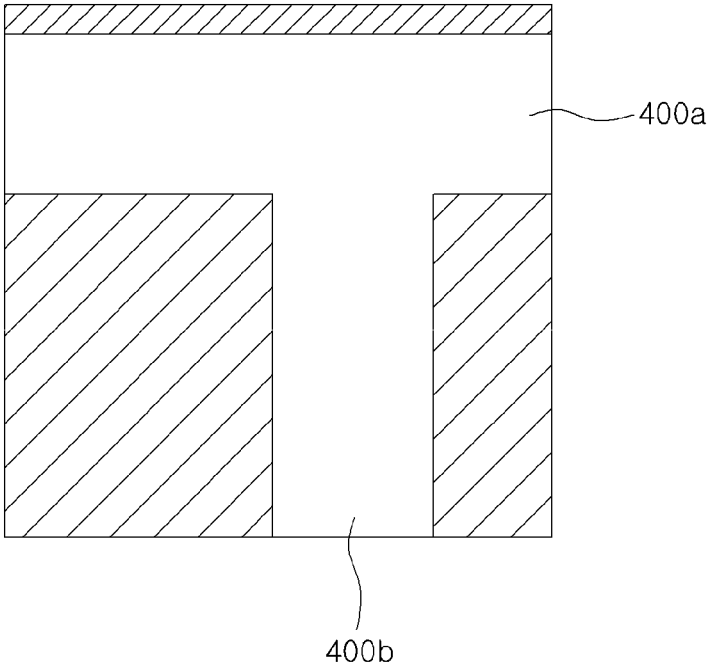
FIG. 4 illustrates another example of a coupling window structure formed in a wall between a metal coaxial resonator cavity and a dielectric resonator cavity in a mixed-mode cavity filter according to an embodiment of the invention.

FIG. 4 illustrates another example of a coupling window structure formed in a wall between a metal coaxial resonator cavity and a dielectric resonator cavity in a mixed-mode cavity filter according to an embodiment of the invention.

Referring to FIG. 4, the vertical window 400*b* forming the coupling window can overlap another portion of the horizontal window 400*a* besides an end portion. If the horizontal window 400*a* and the vertical window 400*b* overlap each other as in FIG. 4, the coupling window can have a "T" shape or a "T" shape with the longitudinal axis biased towards one side.

If a coupling window having a structure such as those illustrated in FIG. 2 to FIG. 4 is formed in a wall between cavities, then coupling is enabled even when the cavities have different resonance modes.

Figure 5:
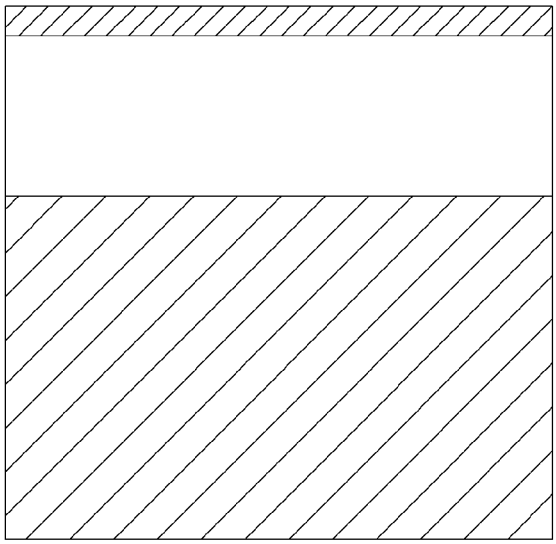
FIG. 5 illustrates a coupling window structure formed in a wall between cavities holding the same type of resonator.

FIG. 5 illustrates a coupling window structure formed in a wall between cavities holding the same type of resonator.

Referring to FIG. 5, a general horizontal window may be formed in a wall between cavities in which the same type of resonator is used. A coupling window a structure similar to that shown in FIG. 5 may be formed in the wall between the second cavity 122 and third cavity 124 and in the wall between the fourth cavity 126 and fifth cavity 128.

The coupling between the second cavity 122 and the fourth cavity 126 may correspond to cross-coupling between cavities having different modes. As is known, cross-coupling may be used to form the transmission zero in such a way that improves the attenuation properties of the filter.

The transmission zero can be formed in a high-frequency band or a low-frequency band of the passband of the filter, and the position of the transmission zero can be adjusted according to the position where the vertical window overlaps the horizontal window.

For example, if the vertical window overlaps a right end of the horizontal window, from the viewpoint of the cavity that receives the coupling towards the cavity that provides the coupling, then (+) coupling may be created, and the transmission zero may be formed in the high-frequency band of the passband. Conversely, if the vertical window overlaps a left end of the horizontal window, from the viewpoint of the cavity that receives the coupling towards the cavity that provides the coupling, then (−) coupling may be created, and the transmission zero may be formed in the low-frequency band of the passband.

Figure 6:
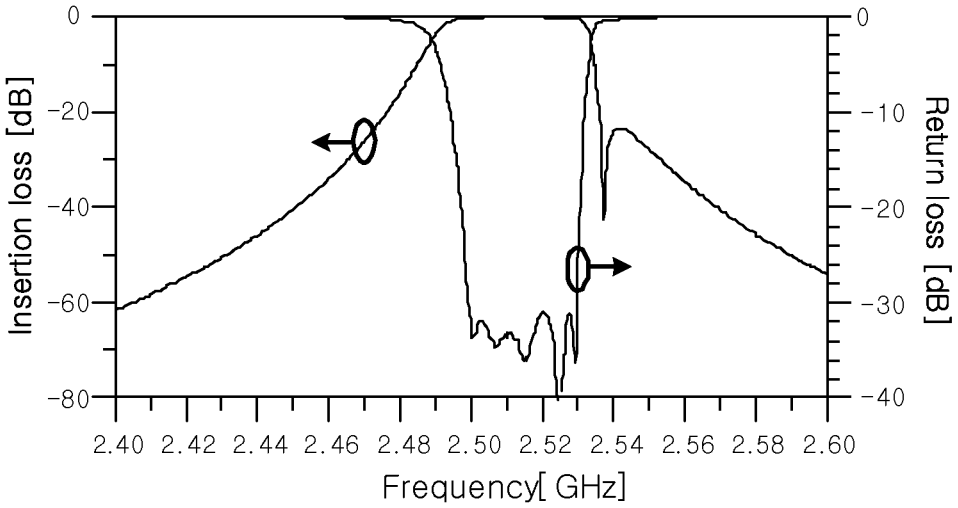
FIG. 6 is a graph illustrating the insertion loss and return loss of the filter illustrated in FIG. 1.

FIG. 6 is a graph illustrating the insertion loss and return loss of the filter illustrated in FIG. 1.

In FIG. 1, from the viewpoint of the fourth cavity 126, which is a cavity that receives the coupling, towards the second cavity 122, which is a cavity that provides the coupling, the vertical window overlaps at the right end of the horizontal window, and thus it can be seen in FIG. 6 that the transmission zero is formed at the high-frequency band of the passband.

Figure 7:
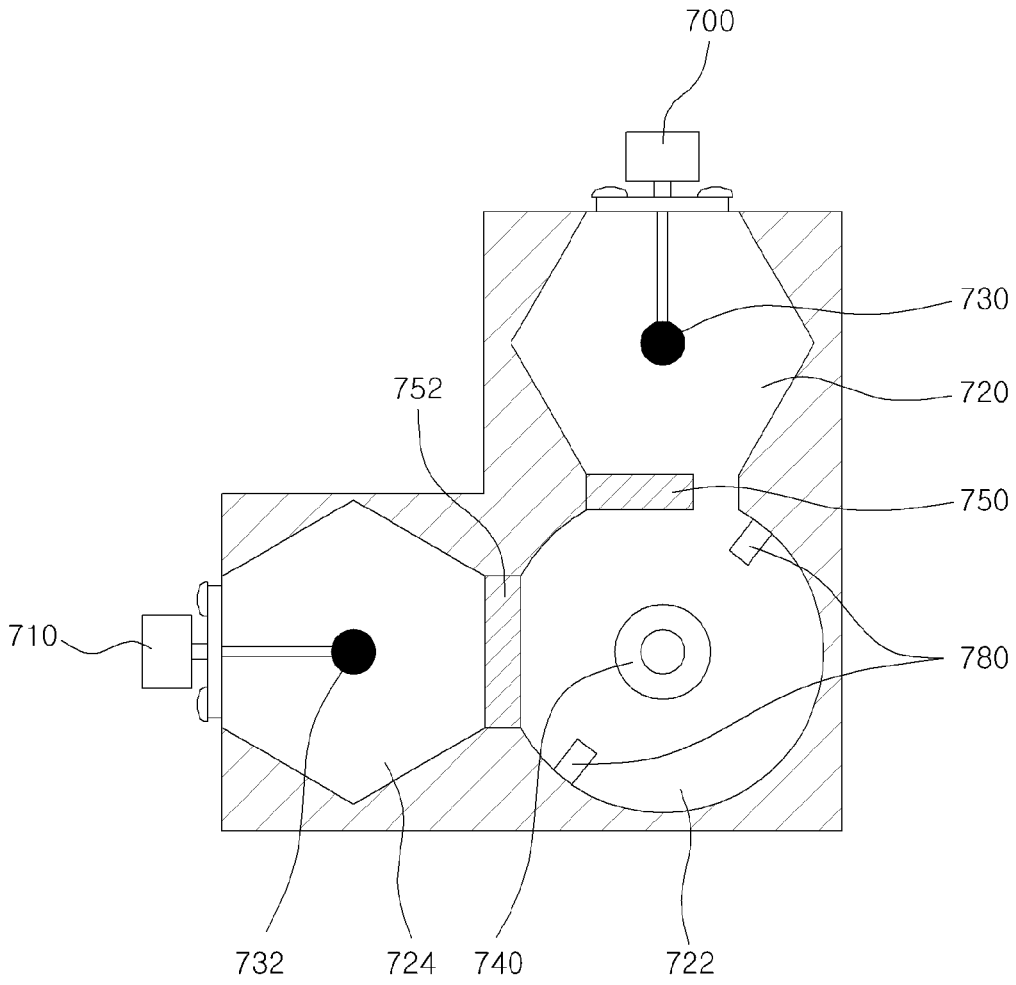
FIG. 7 is a plan view of a mixed-mode cavity filter, with the cover removed, according to a second disclosed embodiment of the invention.

FIG. 7 is a plan view of a mixed-mode cavity filter, with the cover removed, according to a second disclosed embodiment of the invention.

Referring to FIG. 7, the mixed-mode filter according to the second disclosed embodiment of the invention can include an input port 700, an output port 710, a multiple number of cavities 720, 722, 724, metal coaxial resonators 730, 732, and a dual-mode dielectric resonator 740.

Between the cavities, walls 750, 752 may be formed for defining each cavity space, and in each wall 750, 752, a coupling window may be formed for the coupling of signals between cavities.

A filter according to the second disclosed embodiment of the invention may include cavities of different modes, with cavities 720, 724 that hold metal coaxial resonators and a cavity 722 that holds a dual-mode dielectric resonator. The filter according to the second disclosed embodiment has a difference over the structure of the first disclosed embodiment in that it includes a dual-mode dielectric resonator whereas the first disclosed embodiment includes single-mode dielectric resonators.

In the cavity holding the dual-mode dielectric resonator, a perturbation member 780 may be formed. The perturbation member 780 may be a structure that enables coupling between the two modes created by the dual-mode resonator, and a perturbation member of various forms can be formed in the cavity holding the dual-mode dielectric resonator for implementing coupling between the dual modes.

For instance, through the dual-mode dielectric resonator, a first mode and a second mode can exist for the second cavity 722, the first mode creating a magnetic field that is parallel to the magnetic field created by the first cavity 720 and third cavity 724, which use metal coaxial resonators, and the second mode creating a magnetic field that is orthogonal to the magnetic field created by the first cavity 720 and third cavity 724. The modes created in the cavity 722 holding the dual-mode dielectric resonator can be adjusted according to the position of the perturbation member and the form of the dielectric resonator.

In a mixed-mode filter that uses metal coaxial resonators and a dual-mode dielectric resonator together, as in the second disclosed embodiment of the invention, the coupling window may be determined based on the form of magnetic field created in the adjacent cavities.

Figure 8:
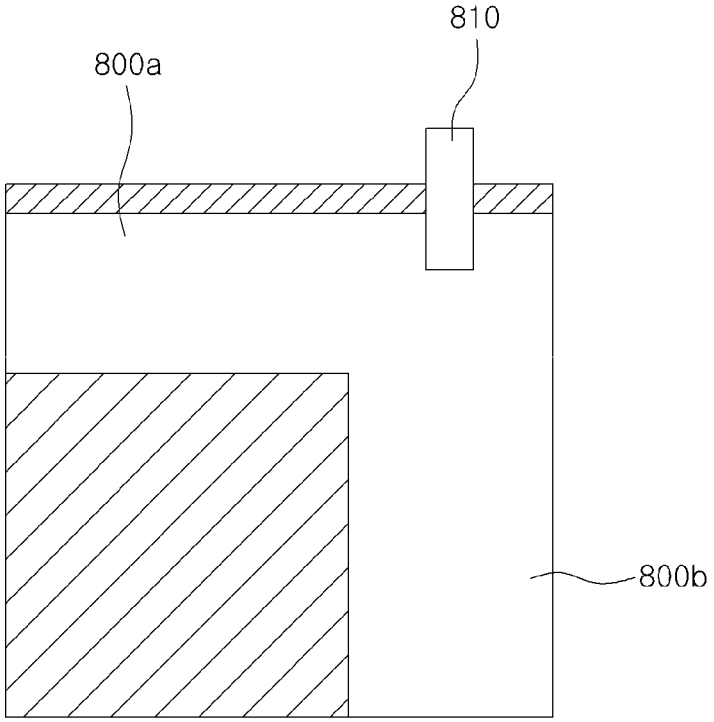
FIG. 8 illustrates an example of a coupling window structure formed between a first cavity 720 and a second cavity 722 in a filter according to the second disclosed embodiment of the invention.

FIG. 8 illustrates an example of a coupling window structure formed between a first cavity 720 and a second cavity 722 in a filter according to the second disclosed embodiment of the invention.

Referring to FIG. 8, a horizontal window 800*a* and a vertical window 800*b* may be included, and the horizontal window 800*a* and the vertical window 800*b* may overlap in a partial area to form an "L" shape. This structure is substantially the same as the coupling window structure used in the first disclosed embodiment when resonators of different modes are adjacent to each other.

Also, referring to FIG. 8, a tuning bolt 810 can be inserted in an area where the vertical window 800*b* is formed. The tuning bolt 810 can be inserted in order to adjust the resonance frequency or bandwidth.

At the first wall 750, the magnetic field of the first cavity 720, in which a metal coaxial resonator 730 is inserted, may be parallel to the first-mode magnetic field and orthogonal to the second-mode magnetic field of the second cavity 722, in which the dual-mode dielectric resonator 740 is inserted.

When coupling is desired between the magnetic field of the first cavity 720 and the first-mode magnetic field of the second cavity 722, a horizontal window may be required for the coupling of the magnetic fields, since the two magnetic fields are parallel. Also, when cross-coupling is desired as well between the first cavity 720 and the second-mode magnetic field of the second cavity 722, a vertical window may be required, since the two magnetic fields are orthogonal. Therefore, a coupling window having both a horizontal window and a vertical window may be formed between the first cavity 720 and the second cavity 722.

Figure 9:
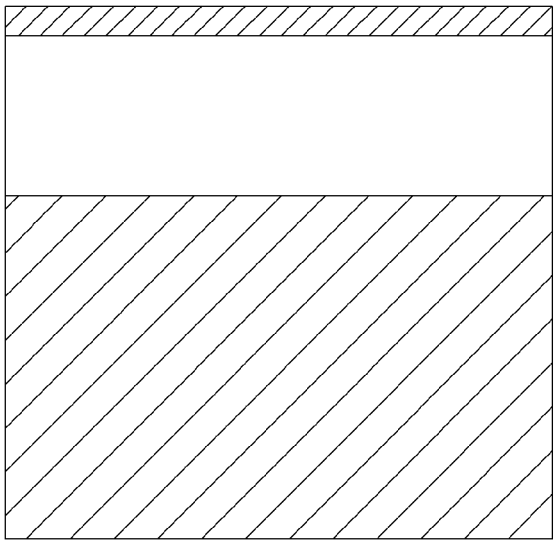
FIG. 9 illustrates the structure of a coupling window formed between a second cavity 722 and a third cavity 724 in a filter according to the second disclosed embodiment of the invention.

FIG. 9 illustrates the structure of a coupling window formed between a second cavity 722 and a third cavity 724 in a filter according to the second disclosed embodiment of the invention.

In a filter according to the second disclosed embodiment of the invention, the second-mode magnetic field of the second cavity 722 and the magnetic field of the third cavity 724 may be coupled, and the second-mode magnetic field and the magnetic field of the third cavity may be parallel at the second wall 752. Thus, FIG. 9 illustrates a horizontal window.

In a mixed-mode filter according to the second disclosed embodiment of the invention where a dual-mode dielectric resonator and metal resonators are used together, if two adjacent magnetic fields being coupled are orthogonal, a coupling window may be formed with a structure such as that shown in FIG. 8, and if two magnetic fields being coupled are parallel to each other, a coupling window may be formed with a structure such as that shown in FIG. 9.

When cross-coupling is achieved in a filter according the second disclosed embodiment of the invention, the position of the transmission zero can be determined based on the position of the perturbation member 780 and the position of the vertical window in the coupling window.

While the present invention has been described above using particular examples, including specific elements, by way of limited embodiments and drawings, it is to be appreciated that these are provided merely to aid the overall understanding of the present invention, the present invention is not to be limited to the embodiments above, and various modifications and alterations can be made from the disclosures above by a person having ordinary skill in the technical field to which the present invention pertains. Therefore, the spirit of the present invention must not be limited to the embodiments described herein, and the scope of the present invention must be regarded as encompassing not only the claims set forth below, but also their equivalents and variations.

What is claimed is:

1. A mixed-mode cavity filter comprising:

at least one first cavity configured to hold a metal coaxial resonator;

at least one second cavity configured to hold a dielectric resonator, and at least one fourth cavity configured to hold a coaxial resonator;

wherein a first coupling window is formed in a wall formed between the first cavity and the second cavity, the first coupling window comprises a horizontal window formed parallel to a bottom portion and a vertical window formed perpendicularly to the bottom portion, and the horizontal window and the vertical window overlap each other in at least a partial area;

wherein a second coupling window is formed in a wall between the first cavities for holding metal coaxial resonators or in a wall between the second cavities for holding dielectric resonators, and the second coupling window has a horizontal structure parallel to the bottom portion; and wherein a third coupling window is formed in a wall for cross-coupling between the first cavity and the fourth cavity, the third coupling window comprises a horizontal window formed parallel to a bottom portion and a vertical window formed perpendicularly to the bottom portion, and the horizontal window and the vertical window overlap each other in at least a partial area.

2. The mixed-mode cavity filter of claim 1, wherein the first coupling window has an "L" shape, a "T" shape, or a "T" shape with a longitudinal axis biased towards either side portion.

3. The mixed-mode cavity filter of claim 1, wherein the horizontal window of the first coupling window is formed in an upper portion of the wall between the first cavity and the second cavity.

4. The mixed-mode cavity filter of claim 1, wherein the third coupling window has an "L" shape, a "T" shape, or a "T" shape with a longitudinal axis biased towards either side portion.

5. The mixed-mode cavity filter of claim 1, wherein a position of a transmission zero by cross-coupling is adjusted according to a position of overlap between the horizontal window and the vertical window of the third coupling window.

* * * * *